US006398442B1

(12) United States Patent
Furukawa

(10) Patent No.: US 6,398,442 B1
(45) Date of Patent: Jun. 4, 2002

(54) WRITING INSTRUMENT

(75) Inventor: Kazuhiko Furukawa, Kanagawa (JP)

(73) Assignee: Mitsubishi Pencil Kabushiki Kaishaki, Tokyo (JP)

( * ) Notice: Subject to any disclaimer, the term of this patent is extended or adjusted under 35 U.S.C. 154(b) by 0 days.

(21) Appl. No.: 09/674,572

(22) PCT Filed: Apr. 30, 1999

(86) PCT No.: PCT/JP99/02337

§ 371 (c)(1),
(2), (4) Date: Oct. 31, 2000

(87) PCT Pub. No.: WO99/56969

PCT Pub. Date: Nov. 11, 1999

(30) Foreign Application Priority Data

May 1, 1998 (JP) ..... 10-135914
Jun. 2, 1998 (JP) ..... 10-167808

(51) Int. Cl.[7] ..... B43K 5/18

(52) U.S. Cl. ..... 401/198; 401/223; 401/225; 401/227; 401/229; 401/230; 401/241

(58) Field of Search ..... 401/198, 205, 401/219, 223, 224, 225, 227, 228, 229, 230, 237, 241, 242

(56) References Cited

U.S. PATENT DOCUMENTS

| | | | | |
|---|---|---|---|---|
| 314,547 A | * | 3/1885 | Stewart | 401/224 |
| 2,921,558 A | * | 1/1960 | Von Platen | 401/224 |
| 6,276,860 B1 | * | 8/2001 | Nakajima et al. | 401/205 X |

FOREIGN PATENT DOCUMENTS

| | | |
|---|---|---|
| JP | 59-184682 | 12/1984 |
| JP | 5-2990 | 1/1993 |
| JP | 7-8234 | 3/1995 |

* cited by examiner

*Primary Examiner*—Gregory L. Huson
*Assistant Examiner*—Kathleen J. Prunner
(74) *Attorney, Agent, or Firm*—Darby & Darby

(57) ABSTRACT

A free-ink collector type writing implement includes ink (12) having a low viscosity of 2 to 100 mPa S, a collector (6) having both an internal pressure regulating function and an ink guiding feed, and a thin reservoir (1) having an ink holding capability connected with the ink guiding feed is accommodated in an ink tank (7), wherein the volumes of the reservoir (1), the ink tank (7) and the collector (6) are set to have an optimum relationship. Furthermore, the ink tank (7) is separated into two parts by a ring (13).

8 Claims, 7 Drawing Sheets

WRITING INSTRUMENT

TECHNICAL FIELD

The present invention relates to improvement of a writing implement such as a ball point pen or a felt-tip pen having a pen point serving as a writing point, the improvement being made to a free-ink type collector type writing implement comprising an ink tank for directly storing an ink, a collector which is a vane type regulating member with a plurality of vanes utilizing a capillary phenomenon, for regulating the interior pressure and means for guiding the ink from the ink tank to the pen point.

BACKGROUND ART

In conventionally known oil-based ball point pens, for the purpose of decreasing the incidences of forward leaking which is a leakage of an ink from a pen point and back leaking which would occur in the condition that the ball point pen is turned upside down and cause staining of clothes or disable writing, an ink having a high viscosity ranging from about 3,000 to 10,000 mPa S is generally used and the capillary force is increased by making the ink tank thinner so as to prevent the ink from moving, thereby preventing occurrence of the above-mentioned leakage, however, with these measures, the problems of heavy writing sensation, blobbing, unevenness of drawing lines, light density and the like arise.

Furthermore, a so-called reservoir type pen in which a reservoir of a fiber bunch is immersed with an ink having a low viscosity of several mPa S, thereby allowing the ink to be guided to the pen point via an ink guiding feed, however this type of pen also involves the problems that consumption of the ink cannot be recognized, and that though an intense drawing line is obtained in the initial stage because the flow amount of the ink is large, the intensity of the drawing line gradually decreases because the flow amount of the ink gradually decreases due to repeated writing. Conduction of the ink from the reservoir can be improved by making a setting to weaken the capillary force of the reservoir, however, this measure also involves the problems with regard to blowing out of the ink that the incidence of blowing-out, the situation that the ink leaks from the reservoir in response to a shock of dropping to stain cloths is increased, and on the other hand, when the capillary force of the reservoir is increased, the flow amount of the ink significantly drops as the writing is repeated, so that the intensity of the drawing line becomes significantly low in the latter stage of lifetime even though the ink remains sufficiently.

For the purpose of solving the above-mentioned problems associated with the oil-based ball point pen and the reservoir type writing implement, a so-called collector type ink direct-storage type writing implement (hereinafter, referred to as "collector type writing implement") is known in which a mechanism used in a fountain pen is applied by disposing an ink tank for directly storing the ink in a rearward position, and regulating the air replacement interior pressure at the time of writing by a collector having a plurality of vane-type grooves. The collector type writing implement has an advantage that the flow amount of the ink is as large as or larger than that in the initial stage of the reservoir type writing implement, making it possible to write with an intense drawing line until the final writing without gradual decrease in the flow amount of the ink even if pen pressure is not applied, however, since it is necessary to make the ink storage amount larger than that of the oil-based ball point pen, the diameter of the ink tank is made large and generally about 1 to 3 cc of ink is stored.

In the conventional collector type writing implement, when the atmospheric pressure of the outside air is changed, the internal pressure is regulated by movement of the ink into the collector, thereby preventing the ink from leaking from the tip of the pen point. In order to prevent volatilization of the ink, it is general to provide a cap which seals the airhole and the pen point concurrently utilizing an undercut, however this measure has a certain problem that as a result of change in the internal pressure of the cap due to attachment/removal of the cap, the ink gradually fills the collector and finally flows out of the collector via the air hole when exceeding a limit of retaining capability, which phenomenon is known as a pumping phenomenon.

In addition, the above mechanism has a problem that as a result of repeated cycles of heating and cooling, or repeated cycles of reduced pressure and high pressure in an airplane, high- or, low-atmospheric pressure, difference in altitude and the like, the blowing out phenomenon occurs similarly. The pumping phenomenon can be dealt by, for instance, adopting a movable inner cylinder into the cap. Meanwhile, in order to solve the problem of blowing out caused by repeated cycles of addition and reduction of the pressure in atmospheric pressure, measures to increase the maximum ink retaining capability of the collector (increase the diameter and length) or to decrease the size of the ink tank have been suggested. However, in the case of currently commercially available products which adapt the above measures, the following problems arise: size of a barrel cylinder is increased to cause a problem regarding appearance; the amount of the ink is decreased to shorten the lifetime, which degrades the cost performance; the collector is made excessively longer and thus the height of the ink head toward the pen point becomes large so that forward leakage is likely to occur; and furthermore, when the above problems are addressed by the ink, it is necessary to use an ink which has extremely low wettability, consequently writing performance must be sacrificed.

Furthermore, in the collector type writing implement, it is possible to keep the intense drawing line until the ink is completely consumed, so that there arises a problem that when the ink runs out during use of the pen, the user meets inconvenience such that writing suddenly becomes no longer possible. Meanwhile, request for improvement of the final writing performance is also proposed as follows: to begin with, the state that ink being almost run out from the tank can be visually recognized from the outside; then, from this point of time, the flow amount of the ink gradually decreases and the writing condition in which the drawing line is visible even if the intensity thereof is weak, that is, during almost all of the lifetime of the pen, a desirable writing performance of free-ink condition is assured; and from the point of the time when the ink within the tank runs out, the performance similar to that of the final writing stage of the reservoir type pen can be assured (that is, normal letter writing can be conducted without any problems, though the drawing line is more or less light and ink starving occurs when a fast writing may be performed).

The main object of the present invention is to improve the widely available collector type writing implement, and to concurrently solve the problem that the significant disadvantage of staining clothes of the consumer due to the repeated up and down cycle of the pressure in the airplane, the problem that there is a request of realizing slim appearance for the collector type writing implement which tends to be thick and the problem of final writing performance which suddenly disables writing when the ink runs out, while satisfying the excellent writing performance possessed by the conventional collector type writing implement, by satisfying the request for reliably improving accident preventing properties of the writing implement, such as preventing property of ink leakage caused by up and down of the atmospheric pressure due to attachment/removal of the cap during use, and blowing-out preventing property during storage of long period in stores.

DISCLOSURE OF INVENTION

The present invention for solving the above-mentioned problems will be summarized as follows.

The first aspect of the present invention is a so-called collector type writing implement comprising: a pen point having a writing point at a tip end thereof; an ink tank for directly storing ink of relatively low viscosity having a viscosity of 2 to 100 mPa S at the room temperature; a collector which is a vane type regulating member composed of a plurality of vanes utilizing a capillary phenomenon for regulating the inner pressure of the interior; and guiding means such as a feed for guiding the ink from the ink tank to the writing point, wherein a reservoir having an ink holding capability is accommodated in the ink tank being connected with the feed which is the ink guiding means.

The second aspect of the present invention is a writing implement according to the above-mentioned first aspect, wherein the reservoir incorporated in the ink tank has a size such that a maximum ink holding volume s of the reservoir falls within the range of 10% to 60% (preferably, 20% to 50%) of an ink tank internal volume i, and a clearance in which the ink in a free-ink state is movable is provided between a periphery of the reservoir and an inner wall of the ink tank.

The third aspect of the present invention is a writing implement according to the above-mentioned first aspect, wherein a maximum ink holding volume s of the reservoir accommodated in the ink tank, a maximum retaining volume c of the vane of the collector and an ink tank volume i satisfy the relationship of: $(i\times70\%)>(s+c)>i\times20\%$.

The fourth aspect of the present invention is a writing implement according to the above-mentioned second aspect, wherein the maximum ink holding volume s of the reservoir accommodated in the ink tank, a maximum retaining volume c of the vane of the collector and the ink tank volume i satisfy the relationship of: $(i\times70\%)>(s+c)>i\times20\%$.

The fifth aspect of the present invention is a so-called collector type writing implement comprising: a pen point having a writing point at a tip end thereof; an ink tank for directly storing ink of relatively low viscosity having a viscosity of 2 to 100 mPa S at the room temperature; a collector which is a vane type regulating member composed of a plurality of vanes utilizing a capillary phenomenon for regulating the inner pressure of the interior; and guiding means such as a feed for guiding the ink from the ink tank to the writing point, wherein a reservoir having an ink holding capability is accommodated in the ink tank being connected with the feed which is the ink guiding means, and the ink tank is separated into a plurality of, or at least two parts by a ring fixed to the ink tank while the reservoir communicating with all of the parts of the ink tank.

Next, the sixth aspect of the present invention is a writing implement according to the above-mentioned fifth aspect, wherein communication means which enables each of the plurality of ink tank parts to ink communicate and air communicate is provided for either one or combination of the ring, the an inner wall of the ink tank and the reservoir in the form of grooves, holes and projections.

Furthermore, the seventh aspect of the present invention is a writing implement according to the above-mentioned sixth aspect, wherein in the ink tank separated into two parts, an ink tank part located at the front end of the pen point side is larger in volume than the following ink tank part.

The writing implement of the present invention having the above-mentioned configuration is a ball point pen having a holder which holds a ball serving as the writing point at the tip end thereof and a guide hole or a plurality of channel grooves for ensuring a flow path from the ink tank to the ball of the writing point with respect to the pen point having a receiving seat for receiving the writing pressure at the time of writing, and further having a feed in the guide hole serving as means for guiding the ink based on the capillary force from the ink tank to the ball; or a felt-tip pen or markers in which the ink guiding feed itself serves as the pen point. Between the ink tank of a bottomed cup shape and the pen point is provided a collector, and an air communication part, a thin ink groove and a vane type groove part are arranged in plural to allow the ink to enter/exit thereto/therefrom, whereby an air hole for regulating the internal pressure of the pen body is realized.

As the means according to the present invention, a reservoir and the like having an ink holding capability is accommodated in the ink tank being connected with the ink guiding feed. The ink is a low (or intermediate) viscosity ink having a viscosity of 2 to 100 mPa S at the room temperature (around 23 degrees). Also ink based on a pseudo-plastic ink (also referred to as a gel ink) and modified to decrease the viscosity to some extent can be used. In the stationary state, the pseudo-plastic ink has a somewhat higher viscosity and prevents the forward leakage, or the leakage of the ink from the tip end, however, when shear or movement occurs in response to writing operation, the viscosity drops so that smooth writing is enabled. Furthermore, as a solvent which constitutes a base for the ink, in addition to water generally used, various kinds of ink utilizing, for example, organic solvents such as lower alcohol, higher alcohol and xylene, glycols such as ethylene glycol, and esters thereof which can be conventionally used for a collector type writing implement, can be appropriately used.

As for the reservoir used in the present invention, those having a property of holding a certain amount of ink, such as a reservoir used for conventional reservoir type writing implement can be used, and by designing the reservoir to be thin or small so as to keep a sufficient space left between the inner wall of the ink tank and the reservoir when accommodated in the ink tank, the advantageous feature of the free-ink type possessed by the collector type will not be disturbed. In order to reduce the expansion of the air caused by up/down of the pressure in the case where the internal air increases as a result of consumption of the ink, part of the space of the ink tank is occupied by the reservoir which holds the ink, and therefore by reducing the total amount of the air which will expand, it is possible to prevent the blowing out even under up/down of the pressure.

As another means, the volume of the reservoir in the tank is made 10% to 60% (preferably 20% to 50%) of the volume of the ink tank. As still another effective means, the maximum ink holding volume s of the reservoir accommodated in the ink tank, the maximum ink retaining space c which is the total space of the vanes of the collector and the ink tank volume i satisfy the relationship of: $(i\times70\%)>(s+c)>i\times20\%$.

Furthermore, as effective means of the present invention, the ink tank is separated into a plurality of (at least two) parts by a ring fixed to the ink tank, and these parts are communicated so as to allow the reservoir to supply the ink from every part of the ink tank, with the result that it is possible to construct easily by centering the reservoir, and in the case of using in the environment with up/down of pressure under the condition that the space is increased as a result of consumption of the ink, the ink is simply held in the rear half of the ink tank, so that it is possible to prevent a large amount of ink from flowing into the collector.

Furthermore, when the communication means implemented by the grooves, holes or projections for enabling each of the plurality of parts of the tank to ink communicate and air communicate with each other is provided for either one (or combination) of the ring, the inner wall of the ink tank and the reservoir, it is possible to regulate the movability of the ink by the ring without adversely affecting the writing and collector function and the like.

Furthermore, the above effect becomes more significant when in the parts of the ink tank separated into more than two parts, the volume of the ink tank part at the front end on the pen point side is made larger than the volume of the rear ink tank part, and in addition, this means is advantageous in the visibility of the ink in the free-ink state and in ensuring the collector function.

In the present invention, though the safety is improved when the volume of the reservoir is made large, the period in which writing performance as the free-ink type is maintained is reduced, and the period in which the flow amount of the ink rather gradually decreases in accordance with the repeated writing is increased as is the case of the ordinary reservoir type, resulting in reducing difference between them. Furthermore, those designed to have a high retaining efficiency of the collector (that is, the collector is large) need a small space for the reservoir, whereas those designed to have a low retaining efficiency (the collector is small) need a large reservoir.

By appropriately selecting and satisfying the above conditions, it is possible to keep the balance between the contradictory characteristics, that is, improvement of the safety regarding reduction of the air volume of the ink tank, attainment of the writing performance such as flow amount of the ink, appearance and visibility regarding ascertaining of the remaining amount of the ink, and the problem regarding the final writing performance that the writing flow amount gradually decreases in the final stage of writing and the final writing suddenly occurs.

The reservoir used in the present invention may be, as same as the conventional reservoir type, those in which threads of short fiber or long fiber are softly fixed within a casing, a so-called fiber bundle in which threads of long fiber are shaped without using a casing by binder or thermosetting, a so-called plastic feed of which snowcrystal-shaped section is formed by extrusion, a sintered feed formed by fixing small particles by heat or binder while maintaining spaces, and a sponge, as far as they have a certain ink holding capability. The interior capillary force can be appropriately selected by the number of the fibers in the reservoir, however, it is possible to set the capillary force weaker than that of the general reservoir type.

The feed and the plastic feed can be formed of the same materials as those of the reservoir, however, since the capability of feeding out the ink from the ink tank to the pen point is required, the capillary force is set stronger than that of the reservoir.

BEST MODE FOR CARRYING OUT THE INVENTION

Figure 1:
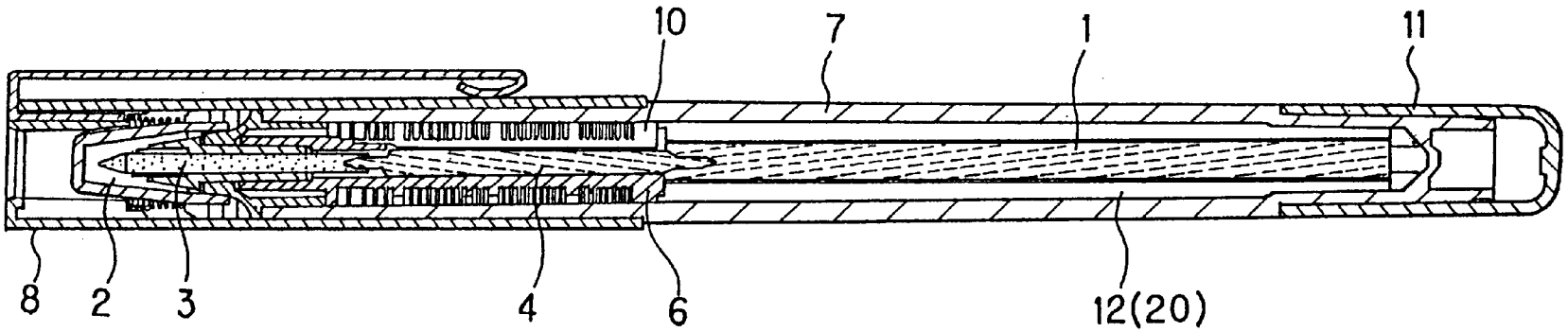
FIG. 1 is a longitudinal sectional view showing the entirety of a writing implement which is the first embodiment of the present invention.
Figure 2:
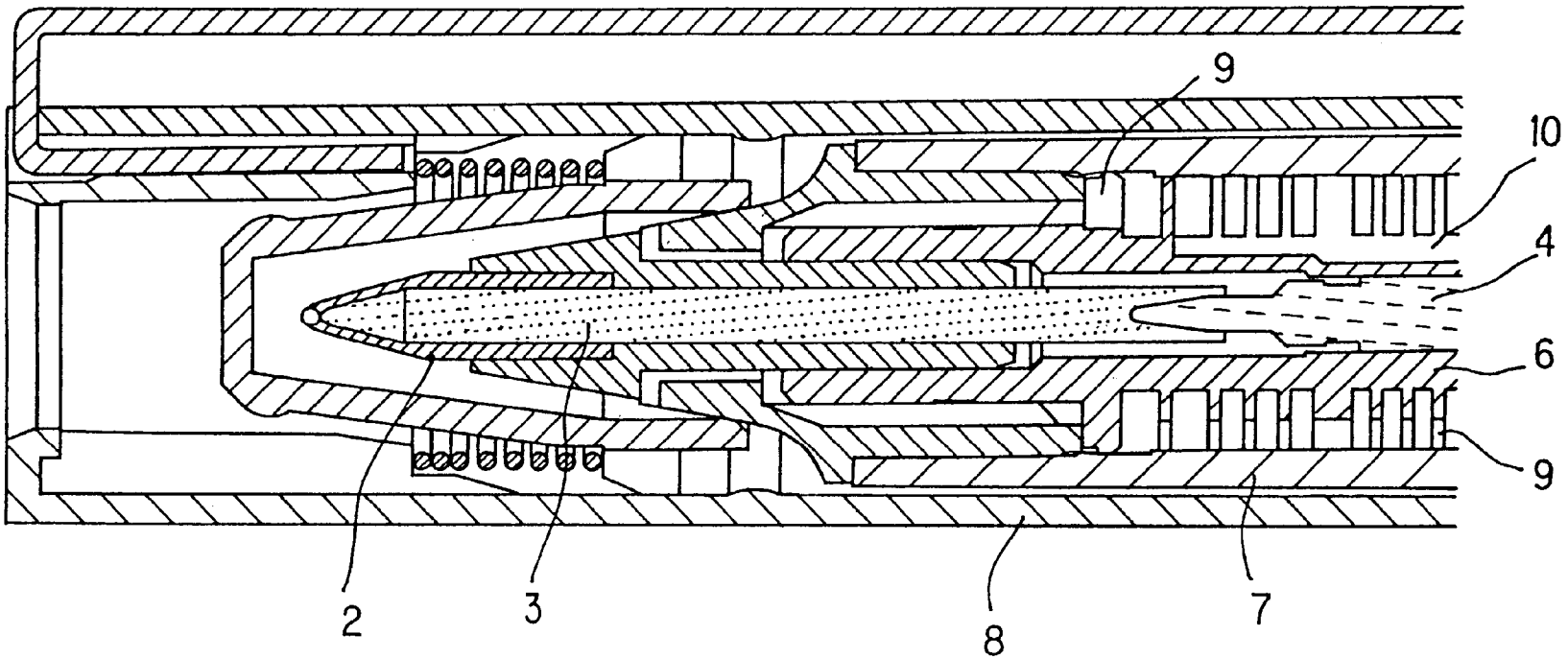
FIG. 2 is a longitudinal sectional view showing a front end side of the writing implement which is the first embodiment of the present invention.
Figure 3:
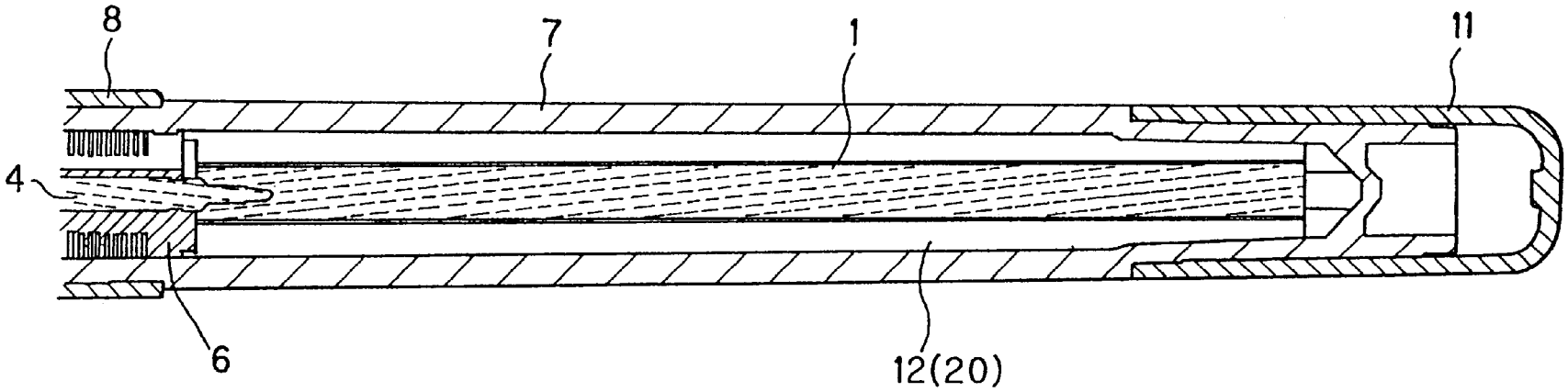
FIG. 3 is a longitudinal sectional view showing a rear end side of the writing implement which is the first embodiment of the present invention.

In the following, embodiments shown in the drawings will be described in detail. FIGS. 1 to 3 show the first embodiment of the present invention. As shown in the drawings, the writing implement of the present invention is a so-called collector type ball point pen in which a ball is loosely fitted into a pen point 2 so as to be rotatable and not to be removable, and an ink 12 is guided to the ball from an ink tank 7 by means of a feed 3. The feed 3 may be the feed 3 which is a long member reaching to the ink tank 7, or combination of a fiber bundle and a plastic feed 4 which is an extruded tube having a capillary force therein and having a section of a snow crystal shape.

The transparent or translucent ink tank 7 made of a synthetic resin which directly stores the ink 12 therein, the water based ink 12 having a relatively low viscosity of 2 to 100 mPa S at the room temperature and occupying more than 40% of the ink tank 7, is tightly fitted with the collector 6 so as not to cause leakage. As colorants having excellent water resistance and light resistance, there are pigments such as direct color and carbon black, pseudo-organic pigments such as dyeing resin powder and the like, however, ink similar to those used in conventional collector type writing implements can be used, and such ink is not particularly limited in the present invention, so that such ink using an organic solvent as alcohol or xylene as a main solvent may be applied for the present invention so far as it satisfies the function as a collector type writing implement.

In particular, when the amount of the air within the ink tank 7 occupies 60% to 70% of the volume of the tank as a result of consumption of the ink at the time of writing (when the amount of remaining ink is slightly larger than that can be held by the collector), the interior and the exterior of the shaft are communicated via a collector 6 having a thin ink groove 10, an air communication part 9 and a plurality of vane type grooves, in order to prevent the ink from leaking from the pen point where the ink passage for writing is attained and to prevent the starving from occurring due to entering of the air from the pen point when there is a change in the internal pressure because of a change in the internal pressure relative to the outside pressure due to the up/down of the atmospheric pressure, and a change in the temperature. The collector 6 has a balancing function of regulating the volume of the interior of the pen body by allowing the ink 12 to flow into/out of the vane-type grooves of the collector 6 when a pressure difference between the exterior and the interior occurs.

A total volume capable of filling the space of the vane-type grooves of the collector 6 with the ink 12 is set to be a retaining efficiency c of 12% or more (preferably 15% to 30%) of the volume of the ink tank 7. Since the rise in the vapor pressure of water and the volume expansion of air resulting from general changes in the atmospheric pressure or temperature rises to the maximum ambient temperature of about 45° C. from the room temperature is about 12%, there arises no problem when the maximum change in volume that is absorbed to the collector 6 is about 12% by the internal pressure regulation. The size of the collector 6 may be appropriately selected depending on the ink to be used, the volume of the ink tank and the like.

As the means of the present invention, a somewhat thin reservoir 1 is fixed to the inside of the ink tank 7 with being connected to the plastic feed 4. Reservoir receiving surfaces of the collector 6 side and the inside of the ink tank 7 are configured by ribs, grooves and the like to allow the ink 12 to enter the reservoir 1 freely. Furthermore, the connection is maintained so as to allow communication of the ink 12 between the plastic feed 4 and the reservoir 1 even in the case of dropping while allowing the reservoir to move to a certain extent.

The thickness of the reservoir 1 is made small so as to leave a sufficient clearance between the inner wall of the ink tank 7 and the casing of the reservoir 1, and the length of the reservoir 1 is made to be substantially equal to the length of the interior of the ink tank 7. In this case, a thick and short reservoir 1 similar to the size of the inner wall of the ink tank 7 may be mounted, however, it is desired to leave a sufficient space especially in the vicinity of the front end of the ink tank on the collector side, in view of the fact the problem regarding to the visibility from the outside is likely to occur that the user misunderstands that the ink remains though the ink 12 has actually completely consumed because of the phenomenon that the ink 12 will not fall from the rear end of the ink tank to the front end side when the movement of the ink 12 toward the front end and the rear end of the reservoir 1 is restricted, or the phenomenon that the ink adhered to peripheral surface of the reservoir 1 persistently remains.

Figure 4:
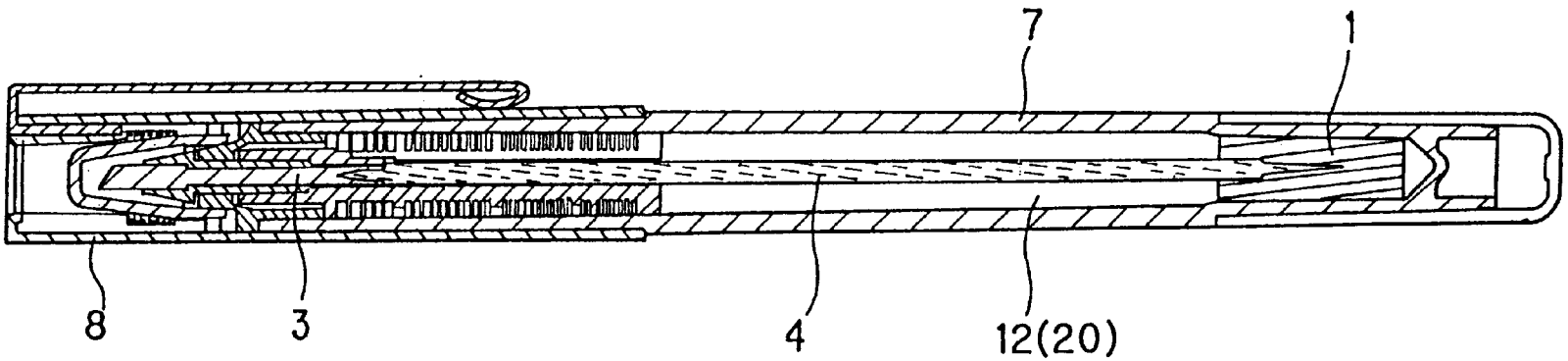
FIG. 4 is a longitudinal sectional view showing the entirety of a writing implement which is the second embodiment of the present invention.

The second embodiment of the present invention is a line maker of which pen point is formed and ground into an arbitrary form by fixing a fiber bundle feed, as shown in FIG. 4, however it also has the operation and effect as same as that of the first embodiment. The difference point between the first embodiment is that the reservoir 1 is made thick and short and disposed in the rear of the ink tank. More specifically, in the rear of the pen point 2, the plastic feed 4 having an intermediate thickness is disposed so as to allow ink communication and further in the rear thereof, the thick reservoir 1 is disposed so as to allow ink communication. That is, a clearance through which the ink (12) in the fee-ink state is movable is provided in the vicinity of the front end of the reservoir (1) on the pen point side. Therefore, by disposing the reservoir 1 having a large volume on the rear side hidden by an opaque plug 11, high efficiency is obtained without considering the problem of appearance, and the problems regarding the visibility and ink movability are eliminated because only the plastic feed 4 which is much thinner than the reservoir 1 is viewed in the visible area from the user.

As a result of investigations and experiments conducted by the present inventor, it was found that there is a close relationship between the volume i of the ink tank, the ink retaining volume c of the collector and the volume s of the reservoir 1. That is, since the size of the collector 6 cannot be made larger than a certain degree because the size in the radial direction is limited by the appearance size and the size in the longitudinal direction is limited by the forward leakage property, in the case where the design is made while placing high importance to the collector volume c, as the ink tank volume i is large, the reservoir volume s may be made large. However, even if the collector volume c is rather small, safety can be ensured as long as the reservoir volume s is large, while on the contrary, if the collector volume c is large, the reservoir volume s can be made smaller. Moreover, it has been conventionally known that the collector volume c must be made larger in proportion to the ink tank volume i, however, by adding the reservoir two findings were obtained as follows:

One of the most suitable range for making the present invention effective is that the ink holding volume s of the reservoir is within the range of 10 to 60%, preferably 20 to 50% of the ink tank volume i.

Another one of the most suitable range for making the present invention effective is that the sum (s+c) of the reservoir volume s and the collector volume c is within the range of 20% to 70% of the ink tank volume i.

Results of actually conducted experiments will be described below. The samples used in these experiments are basically an ink and other members of a collector type water based ball point pen US-150 manufactured by Mitsubishi Pencil K.K., and various kinds of prototypes of reservoirs, collectors and ink tanks were manufactured and compared. The experiments were conducted using a line marker PUS-150 manufactured by Mitsubishi Pencil K.K. having a pen point as shown in FIG. 4, however, the results were completely the same so that only results for UB-150 will be shown in this context.

Furthermore, since the sample in which the length of the collector is increased so as to increase the collector volume c caused forward leakage, the result thereof is omitted.

Since the samples utilize the same basic writing members such as ink, pen point and ink guiding feed as the commercially available product, and cause no problems, evaluations were made for three evaluation items as follows.

1. Writing performance: Visual inspection results of the writing flow amount and writing line in the ISO automatic inspiral machine writing.
2. Final writing performance: Represented by the distance in which starving is gradually occurring from the normal state. Optimum value is around 200 m.
3. Blowing out due to repetition of low pressure: Occurrence of blowing out by the repeated cycle of 0.8 atm. which is equivalent to the pressure in airplane, and 1 atm.

The evaluations were made by the following 3 evaluation points with comments.

○: No problem.

Δ: Some problem but available for practical use.

X: Need attention for practical use or large problem.

Conventional Example

Commercially available UB-150; Collector volume c=0.3 cc (i×15%); Ink tank volume i=2.0 cc; Reservoir volume s=0 cc (Not used)

Results

Writing performance: ○

[There was no problem in the writing performance.]

Final writing performance: X

[Writing suddenly terminated at 50 m or less.]

The blowing out due to repetition of low pressure: X

[Blowing out occurred at the first time.]

EXAMPLE 1

$C=i\times15\%$; $i=2.0$ cc; $s=i\times10\%$

Results

Writing performance: ○

[There was no problem in the writing performance.]

Final writing performance: ○

[The line intensity slightly decreased in the last 100 m to reach the final writing.]

The blowing out due to repetition of low pressure: Δ

[Blowing out occurred at the fourth time and there after, though three repetitions were cleared.]

EXAMPLE 2

$C=i\times15\%$; $i=2.0$ cc; $s=i\times50\%$

Results

Writing performance: Δ

[The flow amount slightly tends to decrease gradually.]

Final writing performance: Δ

[The line intensity decreased in the last 300 m to reach the final writing.]

The blowing out due to repetition of low pressure: ○

[Blowing out did not occur at the fifth time and there after.]

EXAMPLE 3

$C=i\times8\%$; $i=2.0$ cc; $s=i\times60\%$

Results

Writing performance: Δ

[The flow amount slightly tended to decrease gradually.]

Final writing performance: Δ

[The line intensity decreased in the last 300 m to reach the final writing.]

The blowing out due to repetition of low pressure: Δ

[Blowing out occurred at the third time and there after, though two repetitions were cleared.]

EXAMPLE 4

$C=i\times30\%$; $i=1.0$ cc; $s=i\times10\%$

Results

Writing performance: ○

[Though there was no problem in the writing performance, the lifetime was short.]

Final writing performance: ○

[The line intensity slightly decreased in the last 100 m to reach the final writing.]

The blowing out due to repetition of low pressure: ○

[Blowing out did not occur at the fifth time and there after.]

EXAMPLE 5

$C=i\times15\%$; $i=1.0$ cc; $s=i\times50\%$

Results

Writing performance: Δ

[The flow amount slightly tended to decrease gradually, and the lifetime was short.]

Final writing performance: Δ

[The line intensity decreased in the last 300 m to reach the final writing.]

The blowing out due to repetition of low pressure: ○

[Blowing out did not occur.]

EXAMPLE 6

$C=i\times8\%$; $i=3.0$ cc; $s=i\times60\%$

Results

Writing performance: Δ

[The flow amount slightly tended to decrease gradually.]

Final writing performance: Δ

[The line intensity decreased in the last 300 m to reach the final writing.]

The blowing out due to repetition of low pressure: Δ

[Blowing out occurred at the fourth time.]

EXAMPLE 7

$C=i\times8\%$; $i=3.0$ cc; $s=i\times20\%$

Results

Writing performance: ○

[There was no problem in the writing performance.]

Final writing performance: ○

[The line intensity slightly decreased in the last 200 m to reach the final writing.]

The blowing out due to repetition of low pressure: Δ

[Blowing out occurred at the second time.]

Comparative Example 1

$C=i\times15\%$; $i=2.0$ cc; $s=i\times5\%$

Results

Writing performance: ○

[There was no problem in the writing performance.]

Final writing performance: X

[The line intensity somewhat suddenly decreased within the last 100 m to reach the final writing.]

The blowing out due to repetition of low pressure: Δ~X

[Blowing out occurred at the second time.]

Comparative Example 2

$C=i\times15\%$; $i=2.0$ cc; $s=i\times70\%$

Results

Writing performance: X

[Significant decrease in flow amount was observed in the last half period.]

Final writing performance: X

[The line intensity gently decreased in the last 400 m to reach the final writing.]

The blowing out due to repetition of low pressure: ○

[Blowing out did not occur.]

Comparative Example 3

$C=i\times 24\%$; $i=1.0$ cc; $s=i\times 70\%$

Results

Writing performance: X

[Just like a reservoir type, the flow amount decreased gradually and the lifetime was short.]

Final writing performance: X

[The line intensity continued decreasing gradually in the last 800 m to reach the final writing.]

The blowing out due to repetition of low pressure: ○

[Blowing out did not occur.]

Comparative Example 4

$C=i\times 15\%$; $i=3.0$ cc; $s=i\times 5\%$

Results

Writing performance: ○

[There was no problem in the writing performance.]

Final writing performance: X

[The line intensity somewhat suddenly decreased within the last 100 m to reach the final writing.]

The blowing out due to repetition of low pressure: Δ~X

[Blowing out occurred at the second time.]

Comparative Example 5

$C=i\times 5\%$; $i=3.0$ cc; $s=i\times 10\%$

Results

Writing performance: ○

[There was no problem in the writing performance.]

Final writing performance: Δ

[The line intensity somewhat decreased within the last 100 m to reach the final writing.]

The blowing out due to repetition of low pressure: X

[Blowing out occurred at the first time.]

Figure 5:
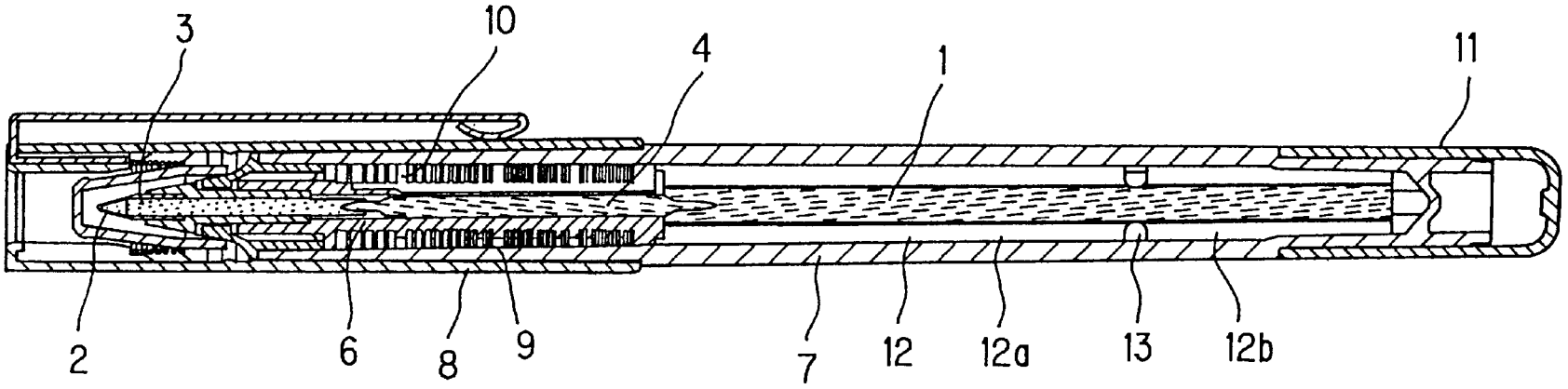
FIG. 5 is a longitudinal sectional view showing the entirety of a writing implement which is the third embodiment of the present invention.
Figure 6:
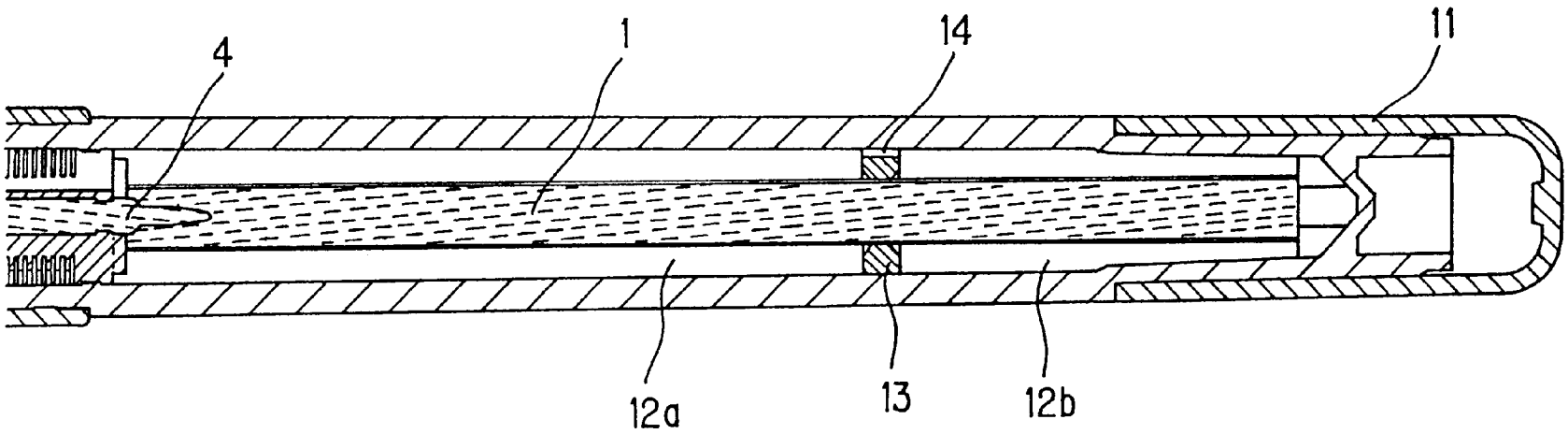
FIG. 6 is a longitudinal sectional view showing a rear end side of the writing implement which is the third embodiment of the present invention.
Figure 7:
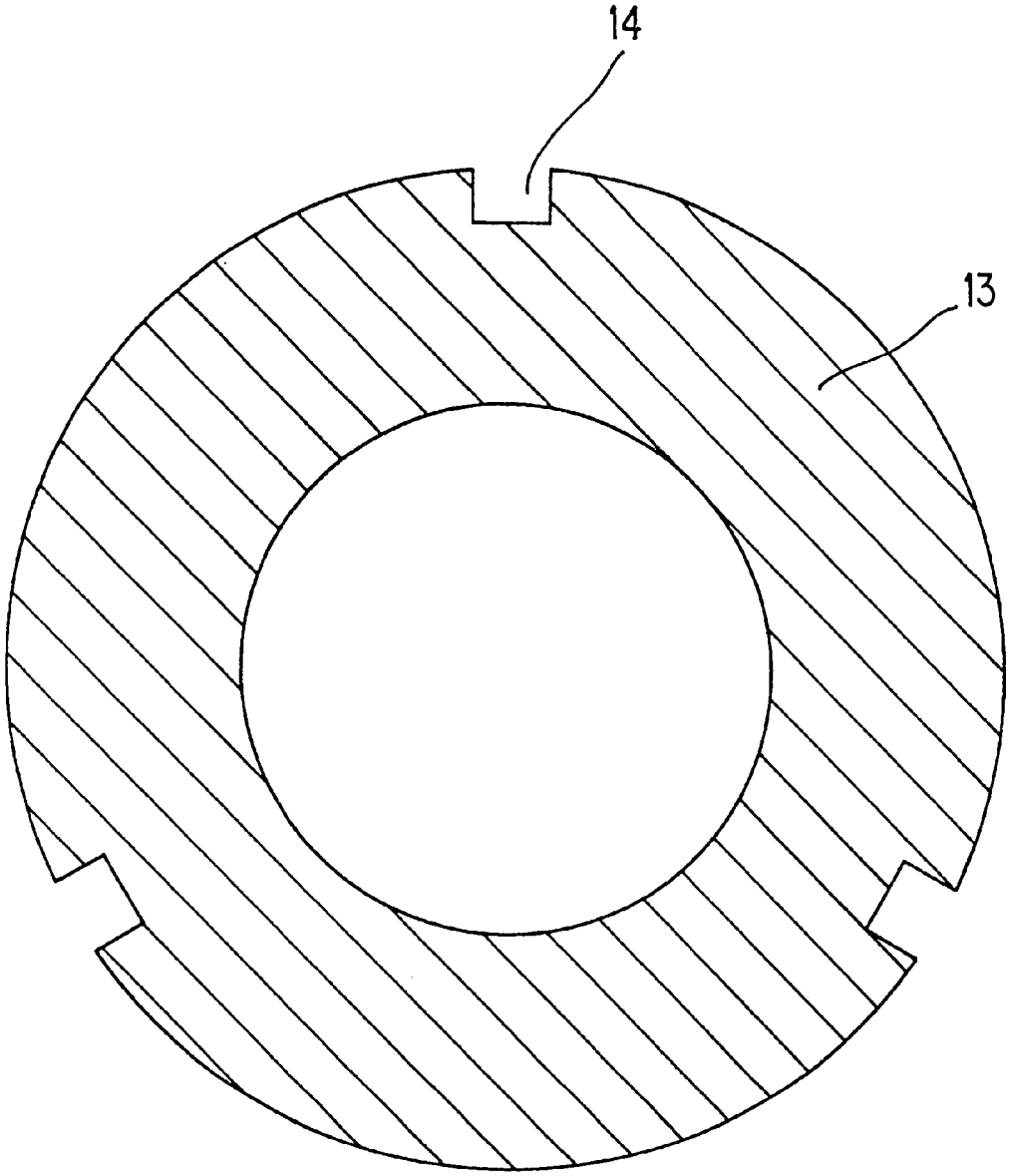
FIG. 7 is a transverse cross sectional view showing a ring member of the writing implement which is the third embodiment of the present invention.

As shown in FIGS. 5 to 7, in the third embodiment of the present invention, in addition to mounting the above-mentioned small reservoir 1, by fixing a ring 13 to the inner wall of the ink tank, the ink tank 7 is separated into a pen point side tank 12*a* and a plug side tank 12*b* so that the reservoir 1 communicates with both of the tanks 12*a,* 12*b*. The ring 13 slightly restricts movement of the ink 12 (including the internal air) by the reservoir 1 on the inner side of the ring 13 and by the inner wall of the ink tank 7 on the outside of the ring 13.

In the state that the pen is inserted into a pocket with a cap 8 being attached, the ink 12 is mainly stored in the rear ink tank 12*b,* and when the pen point 2 is turned down, the ink 12 gradually moves toward the front ink tank 12*a* while the ink temporarily remaining in the rear ink tank 12*b*.

In order to make the present invention operate effectively, it is desirable to provide communication means 14 by grooves, holes and projections that enables ink communication and air communication between the plurality of ink tanks 12*a,* 12*b* for either one or combination of the ring 13, the inner wall of the ink tank 7 and the reservoir 1. In the present embodiment, a plurality of grooves 14 are provided for the ring 13.

If the groove 14 is too large, the effect of separating the ink tank is diminished, while on the other hand, if the groove 14 is too small, the ink 12 stops in the rear ink tank 12*b* persistently so that the ink head applies on the pen point 2 and the ink leaks from the pen point, causing the trouble of forward leakage. Therefore, it is necessary to make appropriate selection of the type of the ink 12, the size of the ink tank 7 and the like.

It is further effective that the groove 14 is disposed in plural because the groove 14 has to replace the air and the ink, and when disposed in one position, the groove 14 is made to have an odd shape.

It is also possible to provide an appropriate communication restriction for the ink 12 by providing grooves and ribs on the inner wall of the ink tank 7 or combining members between the reservoir 1 and the ring 13.

The space between the ring 13 and the inner wall of the ink tank 7, or the space between the ring 13 and the reservoir 1 may be simply left as an appropriate clearance, however, by providing the groove 14 and the like, it is possible to obtain more reliable effect.

Moreover, the configuration where in the ink tank 7 separated into more than two parts, the volume of the ink tank 12*a* at the front end on the pen point side is made larger than the volume of the rear ink tank 12*b* is desirable from the view point of the stability of the air replacement ability at the time of continuous writing and improving effect of measure for pressure reduction in airplane.

In the conventional collector type writing implement, regulation of the internal pressure to about 12% is conducted only by the collector as described above. However, in the case of the airplane, the atmospheric pressure is reduced to about 0.8 atm., and also influence of changes in the body temperature and the outside temperature are added. However, the conventional collector type writing implement does not take the pressure reduction in the airplane into account, so that the accident of blowing out will happen because of the pressure change exceeding the maximum holding capability of the collector.

In the following, the phenomenon taking into consideration of the use in the airplane will be described. The user puts a cap at approximately 1 atm. and boards the airplane, and then the cap 8 is removed under the condition that the pressure becomes 0.8 atm. In such a case, the ink suddenly enters the internal pressure regulating groove of the collector 6 so as to take a balance of the higher internal pressure within the ink tank 7 and the lower external pressure because of the condition where the internal pressure is kept at 1 atm. owing to the sealing ability of the cap is cancelled. After that, the user finishes writing and puts the cap again, and then the writing implement is kept in a condition that the internal pressure is balanced at 0.8 atm. owing to the sealing ability of the cap 8.

When the user removes the cap 8 in a condition of 1 atm. after returning to the ground, the ink 12 held within the collector 6 tends to return immediately to the ink tank 7 side, however because of abrupt change in pressure, some air enters the ink tank while the ink 12 returns to the tank, so that there arises a phenomenon that the ink is kept being held in the collector 6. That is, since the collector 6 has already been filled with the ink, there is no allowance to regulate the internal pressure afterward in the case of slight temperature changes or in the base of repeated boarding that the user boards an airplanes and uses the pen again, which can be lead to a blowing out accident. The abrupt change in pressure can be avoided by using the cap 8 not having a sealing ability and the above problem is reduced, however, volatilization of the ink 12 is increased, and malfunctions tend to occur with time that the ink solidifies or the viscosity of the ink is increased to cause starving.

Even in a current product, the thickness of the collector type writing implement is rather large, and if the thickness would be made further large, drawbacks regarding the thickness of the grip portion and appearance will occur, while if the collector 6 is made longer than the conventional one, the length of the interior of the collector 6 makes the ink head applied to the pen point 2, so that the problem of forward leakage wherein the ink leaks from the pen point will occur. If the volume of the ink tank 7 is made smaller, the retaining efficiency is increased to improve the safety even if the size of the collector 6 is not changed, however the problem regarding the writing lifetime will occur. In particular, in the case of the free-ink writing implement, the flow amount is large and stable from the initial stage to the final stage, so that the same lifetime cannot be achieved unless the mounting amount of the ink is increased compared to the reservoir type writing implement in which the consumption amount of the ink decreases gradually.

According to the present invention, in addition to the effect achieved by mounting the reservoir (1), when the pen point is changed from the state that the pen point is directed upward to the state that the pen point is directed downward, the ink (12) is temporarily retained in the rare ink tank **(12*b*), so that the effect that in the case of abrupt change in the pressure at the time of use in the airplane, the amount of the ink (12) to be entered into the retaining groove of the collector (6)** is temporarily, decreased is achieved.

Industrial Applicability

The configuration and operation of the writing implement according to the present invention are as described above, and by mounting a rather thinner reservoir, it is almost unnecessary to reduce the initial mounting amount of the ink, and even when the space inside the tank is increased as a result of consumption of the ink, the reservoir sufficiently absorbs and holds the ink within the space of the tank. Since the ink enabling writing is held by the reservoir as well as the space itself in the tank is decreased, as the amount of the air in the tank which expands and shrinks is reduced, there is a period up to the final writing in which only the ink that the reservoir has absorbed remains and the ink in the free-ink state does not exist after ink consumption of more than a certain degree, nevertheless, there would be a certain period wherein writing of a rather poor intensity available for memos is enabled near the final writing.

In the reservoir type writing implement, the amount of volume expansion caused by changes in pressure and temperature is not influenced by the air communication through air hole to atmosphere. That is, during the period in which there is no free ink, up/down of the pressure and changes in temperature do not influence the same as the case of the reservoir type writing implement, so that it is possible to significantly improve the safety compared to the conventional collector type writing implement having the same lifetime. From the view point that the period in which the writing implement functions as the free-ink type is sufficiently longer than the conventional reservoir type, the ink amount itself held by the reservoir is slight and small, and the ink will not leak outside the writing implement owing to the ink tank and the collector even in the case of a shock such as dropping, the period in which the flow amount decreases gradually can be set so as not to cause a practical problem similar to the conventional free-ink type by setting the capillary force of the reservoir slightly smaller.

According to the present invention, in consideration of use in an airplane as well as mounting of the reservoir as described above, the ink is temporarily held when the writing implement is turned from the state that the pen point is directed upward to the state that the pen point is directed downward for writing, whereby the effect of preventing a blowing out accident is achieved even in the case of abrupt change in pressure. Since the ink stored in the rear ink tank gradually moves forwardly via the grooves and the like, the internal pressure regulating function and the writing performance of the collector type writing implement will not be adversely affected.

Furthermore, in the case where the ring is positioned so that the ink tank at the front end is larger in volume than the rear ink tank, an adverse effect on the writing performance at the time of continuous writing and a problem regarding the appearance will not occur, and there arises an effect that the temporary storage of the ink under reduced pressure is efficiently achieved.

Furthermore, it is necessary to insert the feed into the reservoir at the time of construction, however, by providing the ring with a chamfer and the like, it is possible to center the reservoir, thereby realizing the structure which can be easily constructed as well as realizing the above-mentioned effects.

Since the present invention has useful effects as described above by complementing the disadvantages of the reservoir type and the collector type writing implements, there are advantages of not only complementing the disadvantages of the reservoir type and the collector type writing implements, but also making the most of the respective advantages.

Since the writing implement according to the present invention has several excellent effects as described above, it is possible to realize a writing implement with slim and good appearance and excellent cost performance. Furthermore, since the pumping phenomenon is unlikely to occur under the up/down of the pressure and temperature change in the airplane or caused by on/off of the cap, the need of the complicated pumping resistant mechanism is eliminated, consequently, it is possible to ensure the safe and stable writing performance. Especially, a writing implement which does not cause a blowing out accident even in the environment that reduction of the pressure is repeated in the airplane such that a business man who uses the writing implement while transferring airplanes experiences can be realized.

Furthermore, there is an effect that it is possible to provide a collector type writing implement having simple structure as described above, low price, good appearance and excellent long-term storage performance, which can easily be manufactured. Furthermore, with regard to the problem that the ink abruptly runs out at the final stage of writing so that writing has to be discontinued, at least such degree as memo writing may be possible for the time because the flow amount of the ink gradually decreases in an appropriate period which is not too long, so that it is not necessary to prepare another writing implement in the final stage of the writing.

What is claimed is:

1. A collector type writing implement comprising: a pen point (2) having a writing point at the tip end thereof; an ink tank (7) for directly storing ink (12) of relatively low viscosity having a viscosity of 2 to 100 mPa S at room temperature; a collector (6) having a vane-type regulating member composed of a plurality of vanes utilizing a capillary phenomenon for regulating air pressure within the writing implement; guiding means forming a feed (3) for guiding the ink from the ink tank to the writing point; an ink holding reservoir (1) accommodated in the ink tank (7) in at least a rear position of the ink tank (7) and connected with the feed (3); and a clearance (20) through which the ink (12) in a free-ink state is movable is provided in at least the vicinity of the pen point side of the reservoir (1).

2. The writing implement according to claim 1, wherein the reservoir incorporated in the ink tank (7) has a size such that the maxium ink holding volume s of the reservoir (1) falls within the range of 10% to 60% of an ink tank internal volume i, and the clearance (20) in which the ink (12) in a free-ink state is movable is provided between a periphery of the reservoir (1) and an inner surface of the ink tank.

3. The writing implement according to claim 2, wherein the maximum ink holding volume s of the reservoir (1) accommodated in the ink tank (7), a maximum retaining volume c of the vanes of the collector (6) and the ink tank volume i satisfy the relationship of: $(i\times70\%)>(s+c)>i\times20\%$.

4. The writing implement according to claim 2 wherein the maximum ink holding volumn s of the reservoir (1) falls within the range of 20% to 50% of an ink tank internal volume i.

5. The writing implement according to claim 1, wherein a maximum ink holding volume s of the reservoir (1) accommodated in the ink tank (7), a maximum retaining volume c of the vanes the collector (6) and an ink tank volume i satisfy the relationship of: $(i\times70\%)>(s+c)>i\times20\%$.

6. A collector type writing implement comprising: a pen point (2) having a writing point at a tip end thereof; an ink tank (7) for directly storing ink (12) of relatively low viscosity having a viscosity of 2 to 100 mPa S at room temperature; a collector (6) having a vane-type regulating member composed of a plurality of vanes utilizing a capillary phenomenon for regulating air pressure within the writing implement; guiding means forming a feed (3) for guiding the ink from the ink tank (7) to the writing point; an ink holding reservoir (1) accommodated in the ink tank (7) and connected with the feed (3); and the ink tank (7) is separated into a plurality of or at least two parts by a ring (13) fixed to an interior surface of the ink tank (7) while the reservoir (1) communicates with all of the parts of the ink tank (7).

7. The writing implement according to claim 6, wherein communication means (14) is provided either by one or the combination of the ring, the interior surface of the ink tank, and the reservoir tank enable each of the plurality of ink tank (7) parts to ink communicate and air communicate, the communication means being in the form of grooves, holes and projections.

8. The writing implement according to claim 7, wherein the ink tank (7) is separated into two parts such that one ink tank (7) part located on the pen point (2) side is larger in volume than the other ink tank part.

* * * * *

UNITED STATES PATENT AND TRADEMARK OFFICE

CERTIFICATE OF CORRECTION

PATENT NO. : 6,398,442 B1
DATED : June 4, 2002
INVENTOR(S) : Kazuhiko Furukawa

It is certified that error appears in the above-identified patent and that said Letters Patent is hereby corrected as shown below:

Title page, Item [54] and Column 1, line 1,
Delete "WRITING INSTRUMENT" and substitute -- WRITING IMPLEMENT --

Title page,
Item [73], Assignee, delete "Mitsubishi Pencil Kabushiki Kaishaki" and substitute -- Mitsubishi Pencil Kabushiki Kaisha --

Signed and Sealed this

Third Day of June, 2003

JAMES E. ROGAN
*Director of the United States Patent and Trademark Office*